United States Patent [19]

Jones

[11] Patent Number: 4,654,991

[45] Date of Patent: Apr. 7, 1987

[54] TOY OR OBJECT HANGER FOR VISUAL DISPLAY

[76] Inventor: Leila H. Jones, 1045 River Rd., Sykesville, Md. 21784

[21] Appl. No.: 734,111

[22] Filed: May 14, 1985

[51] Int. Cl.[4] ..... G09F 7/22

[52] U.S. Cl. ..... 40/617; 40/124

[58] Field of Search ..... 40/617, 124, 124.2; 224/254, 255; 446/227; 211/113, 115, 118, 89

[56] References Cited

U.S. PATENT DOCUMENTS

| | | | |
|---|---|---|---|
| 442,629 | 12/1890 | Lipscomb | 40/617 |
| 1,136,529 | 4/1915 | Hopwood | 446/227 |
| 1,521,531 | 12/1924 | Hanold | 224/205 |
| 1,642,744 | 9/1927 | Nigro | 224/224 |
| 2,010,572 | 8/1935 | Waterman | 211/113 |
| 2,278,695 | 4/1942 | Fluss | 40/124 |
| 2,279,237 | 4/1942 | Kellems et al. | 248/317 |
| 2,939,234 | 6/1960 | Hill | 40/617 |
| 3,148,812 | 9/1964 | Hilsinger, Jr. | 224/250 |
| 3,170,260 | 2/1965 | Parker | 40/124 |
| 3,327,419 | 6/1967 | Stanos | 40/124 |
| 3,543,977 | 12/1970 | Lockridge | 224/222 |
| 3,676,942 | 7/1972 | Elrod | 40/617 |
| 3,688,348 | 9/1972 | Klotz et al. | 24/16 R |
| 3,709,373 | 1/1973 | Aguilar | 211/113 |
| 3,987,903 | 10/1976 | Swilley | 211/13 |
| 4,052,805 | 10/1977 | Potter | 40/617 |
| 4,387,873 | 6/1983 | Pavlo et al. | 248/231.7 |
| 4,431,041 | 2/1984 | Leiserson | 150/52 J |
| 4,433,803 | 2/1984 | Liberboim | 224/251 |
| 4,435,915 | 3/1984 | Zaruba et al. | 40/617 |

*Primary Examiner*—Gene Mancene
*Assistant Examiner*—Cary E. Stone
*Attorney, Agent, or Firm*—Lowe, Price, LeBlanc, Becker & Shur

[57] ABSTRACT

A toy hanger for visually displaying toys, dolls or the like within a child's room comprises a hanging strap suspendable from a support structure within the room. A plurality of fastening strips attached at spaced intervals along the length of the hanging strap each includes opposite ends carrying hook and loop fastening material adhesively engageable with each other to establish a support loop adjustable in diameter for receiving and supporting a toy or doll on the hanging strap. Male and female hook and loop elements secured to an upper end of the strap are engageable with each other to releasably secure the hanger to a crib, curtain rod and the like. In an alternative embodiment of the invention, the hanging strap includes first and second sections having hook and loop elements at one end of each strap, respectively, for attachment together to form a single strap. In yet another alternative embodiment, the straps are securable at upper ends thereof to carrier arms formed at spaced angular intervals from each other on a carousel structure.

15 Claims, 11 Drawing Figures

TOY OR OBJECT HANGER FOR VISUAL DISPLAY

TECHNICAL FIELD

The present invention relates generally to devices for visually displaying objects within a room and, more particularly to a toy hanger for visually displaying toys, dolls the like within a child's room.

BACKGROUND ART

Children's toys are commonly stored within toy chests, which in addition to taking up floor space, often result in toys placed at the bottom of the chest (1) being completely ignored or forgotten by the child; and (2) crushed or rumpled by the weight of other toys within the chest. Also, to reach a toy stored at the bottom of the chest, the child often removes, dumps and leaves all of the toys on the floor which are then trampled upon during play.

Bookcases are sometimes used for display and storage of toys. Bookcases, however, as well as toy chests, are costly and can be easily toppled by the child, causing possible injury.

It is accordingly one object of the present invention to provide a toy hanger for displaying toys, dolls and the like within a child's room that can be easily mounted to a curtain rod, crib post, or door knob for easy access to the toys by the child.

Another object of the invention is to provide a toy hanger that is economical to purchase, attractive and safe to use. Yet another object of the invention is to provide a hanger that can be used to visually display objects within stores, particularly toys and dolls within children's stores.

DISCLOSURE OF THE INVENTION

A toy hanger for visually displaying toys, dolls and the like within a child's room, in accordance with the present invention, comprises a hanging strap that can be easily mounted to a support structure within the room and a plurality of fastening strips secured at spaced intervals from other to the strap for releasably securing and displaying a toy on the strap.

Preferably, each fastening strip is made of a fabric material secured at an intermediate portion thereof to the strap. Opposite ends of each strip preferably carry hook and loop fastening elements, such as Velcro. When secured together by mating opposite ends of each strip, there is defined a support loop for supporting a toy on the strap. Use of Velcro elements facilitates adjustment of each loop by an infinitely variable amount to provide a snug fit. The fastening elements are easily detached from each other by the child to release the toy.

Each strip is preferably secured at an intermediate portion thereof to the hanging strap so that opposite ends project traversely from the straps. By placing the strips to extend in an inclined direction relative to the longitudinal axis of the hanging strap with adjacent strips being reversably inclined with respect to each other, a balanced distribution of force is obtained when toys are mounted within the fastening strips so that the hanging strap extends in a vertical straight line direction without bulging forward or laterally due to the weight of each toy.

An upper end of the hanging strap preferably carries male and female Velcro elements engageable with each other to establish a mounting loop for releasably securing the toy hanger to a curtain rod, crib post and the like. In the unlikely event that the lower end of the strap wraps around the child's neck, a predetermined minimum amount of weight less than the child's weight is sufficient to cause the Velcro elements establishing the mounting loop to disengage each other, for improved safety.

In accordance with another aspect of the invention, the hanging strap can be formed from plural strap sections attachable to each other using male and female Velcro elements. The toy hanger can be sold as a unit with a carousel-like structure having carrier arms formed at spaced angular intervals that project outward from the upper end of a post supported by a base. This arrangement advantageously allows the individual strap sections each containing fastening strips to be respectively supported on the carrier arms in a suspended position so that toys can be mounted and displayed on the carousel structure.

Snap fasteners and other fastening material can be employed on the fastening strips in place of Velcro fastening elements.

Additional objects, advantages and novel features of the invention will be set forth in part in the description which follows and a part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

FIG. 7A is a perspective view of the upper end of the hanging strap depicted in FIG. 7 to show the manner in which the strap can be mounted to a curtain rod, crib bar and the like;

BEST MODE FOR CARRYING OUT THE INVENTION

Figure 1:
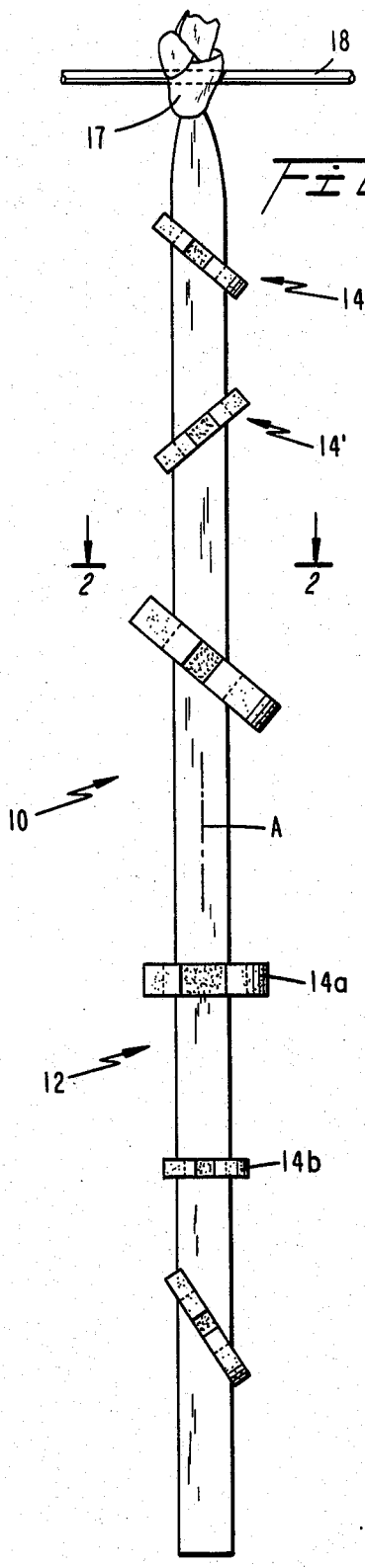
FIG. 1 is a front elevational view of a toy hanger in accordance with a first embodiment of the invention.
Figure 10:
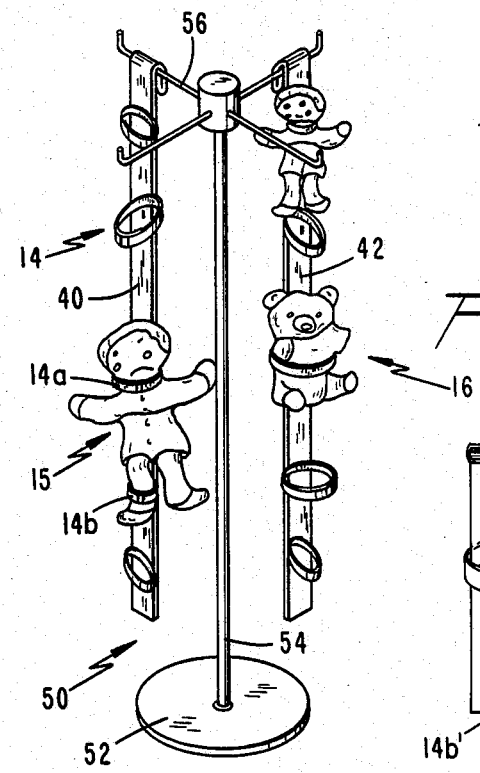
FIG. 10 is a perspective view of a second embodiment of the present invention wherein strap sections depicted in FIG. 6 can be individually supported on a carousel for displaying toys in a child's room or a store.

Referring to FIG. 1, one embodiment of a toy hanger 10 in accordance with the present invention comprises a hanging strap 12 supporting, at spaced intervals from each other, a series of fastening strips 14 having opposite ends engageable with each other to support and visually display dolls 15, stuffed animals 16 and the like on the strap, as depicted in FIG. 10. Hanging strap 12 is preferably formed from a lightweight, durable fabric material that can be easily knotted at an upper end 17 thereof for securing the hanger 10 to a curtain rod 18 (or crib bar, door knob, etc.).

Figure 2:
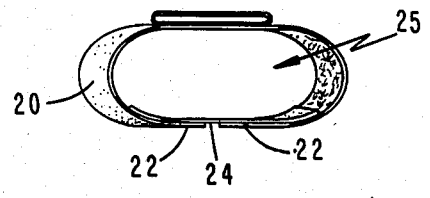
FIG. 2 is a sectional view taken along the line 2—2 of FIG. 1 disclosing one form of a fastening strip used to secure a toy to the hanger.
Figure 3:
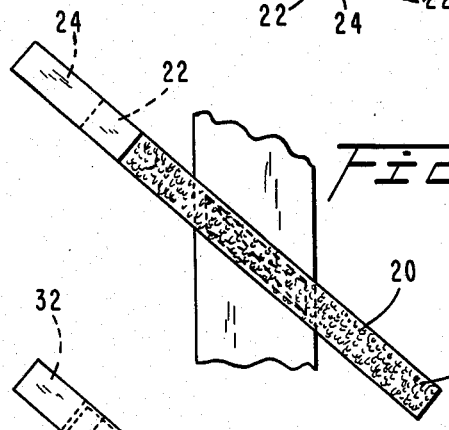
FIG. 3 is an enlarged front view of the fastening strips depicted in FIG. 1.

As shown in FIGS. 1 and 2, each fastening strip 14 can be formed from a first strip of fastening material 20, such as male or female Velcro tape, secured (e.g., by stitching) at an intermediate portion thereof to hanging strap 12. A second strip 24 of complementary Velcro tape is engageable with opposite ends 22 to secure the opposite ends together to establish (when in the mating FIG. 2 position), a support loop 25 adjustable in diameter by an infinitely variable amount to encircle the neck, waist, etc., of a toy for attachment and display on hanging strap 12. In this embodiment of fastening strip 14, first strip 20 is preferably female or loop Velcro tape; second strip 24 is male or hook tape. This arrangement is preferred when it is desired to wash toy hanger 10 since the hook elements of second strip 24 can be completely covered by opposite ends 22 of first strip 20 to prevent accumulation of lint when washing.

As mentioned above, each fastening strip 14 is respectively secured at an intermediate portion thereof to hanging strap 12 so that opposite ends of each strip project transversely from the strap. In addition, it is preferred to fix each strip 14 so that it extends in an inclined direction relative to longitudinal axis A of strap 12, with adjacent strips 14 and 14' being reversely inclined with respect to each other. Inclination of each strip 14 relative to longitudinal axis A tends to prevent a toy supported by strip 14 on strap 12 from projecting forward under its own weight. The reverse inclination of adjacent strips 14,14' stablizes force distribution along strap 12 by preventing lateral bowing of strap 12 inopposite lateral directions (in the vicinity of strips 14,14') due to the weight of the suspended toys. Thus, reverse inclination of strips 14,14' allows strap 12 to hang straight without lateral bowing or flexing when load is imposed on the strap by the weight of the toys.

Figure 9:
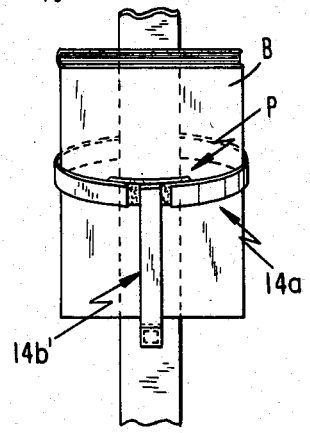
FIG. 9 is an illustration of a pair of fastening strips oriented and fastenable together to establish a pocket for receiving and displaying books on the hanging strap.

To secure a large toy or doll to hanging strap 12, parallel fastening strips **14*a*,14*b* can be secured to strap 12 to respectively encircle (FIG. 10) the chest and feet of the toy. As depicted in FIG. 9, a child's book B and the like can also be supported on strap 12 by means of fastening strip 14*a* and a second strip 14*b'* formed orthogonal thereto mating with the first strip to establish a pocket P. Other fastening strip orientations are within the scope of the present invention for displaying objects of different shape upon hanging strap 12**.

Figure 4:
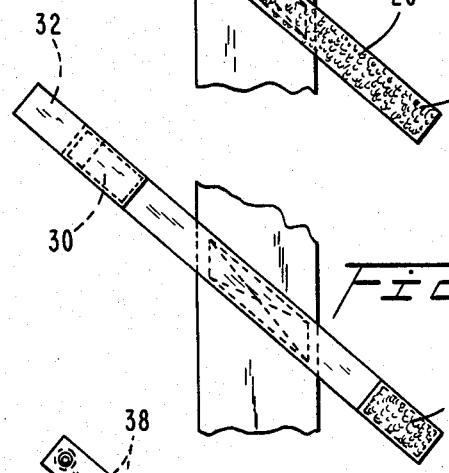
FIG. 4 is an enlarged front view of a second embodiment of a fastening strip.

FIG. 4 is an illustration of an alternative embodiment of fastening strip 14, wherein the fastening strip comprises a length of fabric material 30 respectively carrying at opposite ends thereof male and female Velcro fastening tabs 32 and 34 engageable with each other to establish support loop 25. Since fabric strip 30 constitutes the major portion of fastening strip 14, this arrangement minimizes the amount of relatively expensive Velcro tape (in relation to the cost of fabric strip 30) required to practice the present invention.

Figure 5:
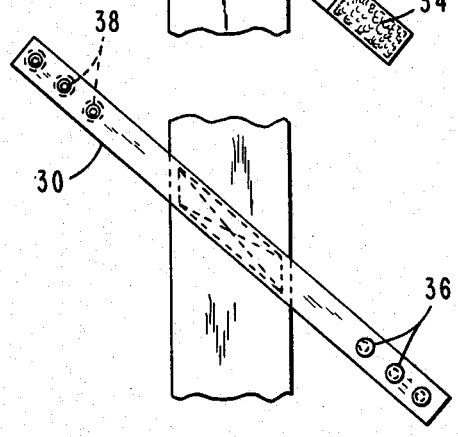
FIG. 5 is an enlarged front view of a third embodiment of a fastening strip.

A third embodiment of fastening strip 14 is depicted in FIG. 5, wherein the fastening strip is formed of a single length of fabric material 30 respectively carrying at opposite ends thereof male snap fasteners 36 and female snap fasteners 38. The provision of plural snap fasteners 36,38 permit variable adjustment of the diameter of support loop 25, although not in an infinitely variable amount as provided by Velcro fastening material.

Figure 6:
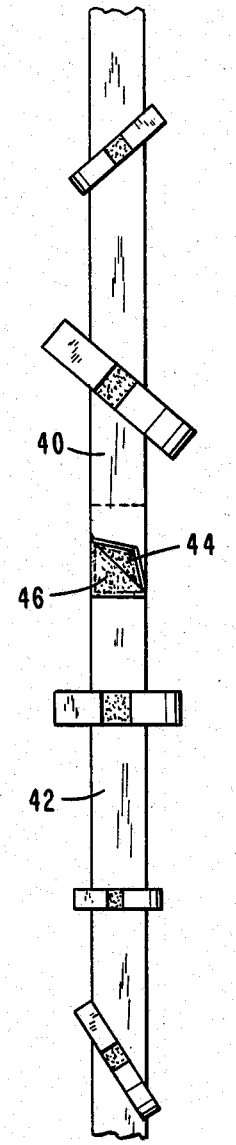
FIG. 6 is a front view of a second embodiment of a hanging strap that can be employed in the present invention.
Figure 7:
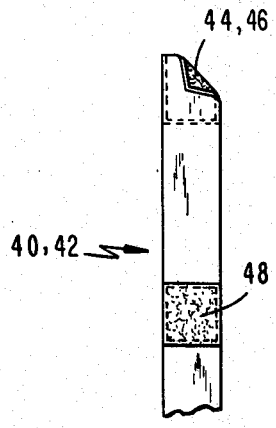
FIG. 7 is an enlarged front view of the upper end of the hanging strap depicted in FIG. 1 depicting a means for mounting the upper end of the hanging strap to a support structure.

FIG. 6 is an illustration of a second embodiment of the present invention wherein hanging strap 12 comprises first and second strap sections 40 and 42 each having one end respectively carrying male and female Velcro tape 44 and 46. Mating of tapes 44,46 together enables first and second straps 40,42 to establish the overall hanging strap 12. However, in accordance with an important feature of the invention, formation of first and second strips 40,42 with a second piece of complementary Velcro material 48 spaced from the associated piece 44 or 46 (see FIG. 7), advantageously allows each strap 40 or 42 to be suspended on a display carousel 50 as depicted in FIG. 10. The carousel 50 includes a base 52, a post 54 and plural carrier arms 56 projecting outward from the upper end of the post at spaced angular intervals to each other. By mating Velcro elements 44 and 48 or 46 and 48 with each other, the resulting mounting loop 60 (see FIG. 7A) permits easy mounting of straps 40,42 to carrier arms 56.

Figure 8:
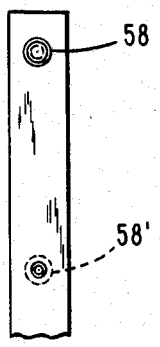
FIG. 8 is an alternative embodiment of the upper end of the hanging strap employing snap fasteners for securing the strap to a support structure.

It will be appreciated that complementary snap fasteners 58 can be substituted fgrVelcro elements 44 and 46 for securing first and second straps 40,42 together. A second complementary snap fastener 58' (see FIG. 8) can substitute for Velcro element 48 to establish mounting loop 60 and thereby suspend straps 40,42 from the carrier arms 56 depicted in FIG. 10.

Figure 7A:
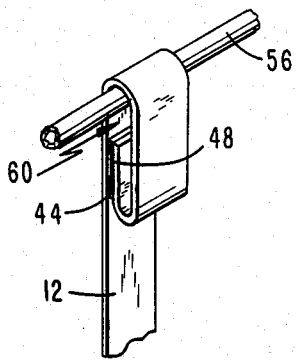

It will be further appreciated in light or the foregoing specification, that Velcro elements 44,46 or 48, or snap fasteners 58,58' can be employed at the upper end of the hanging strap 12 depicted in FIG. 1 to provide a mounting loop 60 for securing the strap to a curtain rod 18, door knob (not shown), crib bar, etc., for easy mounting of toy hanger 10 to stationary elevated structures within the room. Furthermore, by appropriately dimensioning Velcro elements 44,46 and 48, or by securing element 44,46 to one surface of hanging strap 12 and securing element 48 to the opposite surface of hanging strap 12 and thereafter mating the complementary elements together as depicted in FIG. 7A, the resulting mounting loop 60 easily ruptures to release the strap in the event a child's weight is imposed on the lower end of the strap, to prevent possible injury to the child. With the mounting arrangement depicted in FIG. 7A, it will be appreciated that a child's weight is transferred through strip 12 as a force causing element 48 to "peel away" from element 44, thus breaking loop 60.

The foregoing descriptions of preferred embodiments of the present invention have been presented tor purposes of illustration and description. They are not intended to be exhaustive or to limit tne invention to the precise forms disclosed, and obviously, many modifications and variations are possible in light of the above teachings. For example, hanging strap 12 may be mounted horizontally and flush to one or more walls (not shown) with thumb tacks, nails, etc. Also, fastening strips **14,14*a* and 14*b*, may be suitably fixed to structures other than hanging strap 12**, such as wooden strips or blocks, bulletin boards, etc. The embodiments were chosen and described in order to best explain the principles of the invention and their practical application to thereby enable others skilled in the art to best utilize the invention and various embodiments and with various modifications as are suited to the particular use contemplated. It is intended that the scope of the invention be defined by the claims appended hereto.

I claim:

1. A toy hanger for visually displalying toys, dolls and the like within a room, comprising:

(a) a hanging strap;

(b) means for mounting the hanging strap to a support structure, and (c) fastening means secured to the hanging strap for releasably securing a toy or the like to said hanging strap for visual display, wherein said fastening means is a fastening strip having opposite ends connectable with each other to define a support loop for receiving and supporting said toy on the hanging strap.

2. The toy hanger of claim 1, wherein said fastening means includes a plurality of said fastening strips secured to the strap at spaced intervals from each other to define a plurality of loops respectively receiving plural toys or different portions of the same toy.

3. The toy hanger of claim 2, wherein said fastening strips are respectively secured at an intermediate portion thereof to the hanging strap so that opposite ends of said strip project transversely from the strap, said strips extending in an inclined direction relative to the longitudinal axis of the hanging strap with adjacent strips being reversably inclined with respect to each other.

4. The toy hanger of claim 2, wherein a pair of adjacent fastening strips extend generally orthogonal to the hanging strap to receive and support different portions of the same toy.

5. The toy hanger of claim 2, wherein a pair of first and second adjacent fastening strips are formed orthogonal to each other with the first strip having opposite ends engageable to define a first loop and the second strip secured at a lower end thereof to the hanging strap and at an upper end to the first loop, said first and second strips in a secured position defining a pocket for receiving and supporting a book on the hanging strap.

6. The toy hanger of claim 1, wherein said fastening means includes a fastening strip secured to the strap to define a loop for receiving and supporting said toy on the hanging strap.

7. The toy hanger of claim 1, wherein said fastening strip includes means for adjusting the diameter of the support loop.

8. The toy hanger of claim 7, wherein said adjusting means is operable to adjust the loop diameter by an infinitely variable amount.

9. The toy hanger of claim 8, wherein said fastening strip is a tape bearing a plurality of loop projections along an entire length thereof, and further including a second fastening strip formed with hook projections along its length, opposite ends of said strip being adhesively engageable with opposite ends of said second strip to establish said adjustable loop.

10. The toy hanger of claim 7 wherein opposite ends only of said fastening strip are formed with adhesive material engageable to establish said adjustable support loop.

11. The toy hanger of claim 10, wherein said opposite ends respectively carry hook and loop fastening material.

12. The toy hanger of claim 7, wherein said adjusting means includes a plurality of snap fasteners provided at spaced intervals from each other on each end of the fastening strip.

13. The toy hanger of claim 1, wherein said hanging strap includes first and second strap sections, said sections each having one end formed with attachment means for securing said ends together.

14. The toy hanger of claim 1, wherein said mounting means includes first and second pieces of adhesive material attached to one end of the hanging strap, said first and second pieces being adhesively engageable with each other to define a fastening loop for securing said strap to said support structure.

15. A support assembly for visually displaying objects within a room, comprising:

(a) a carousel having a base, a post projecting upward from the base, a plural carrier arms projecting outward from an upper end of the post at spaced angular intervals from each other; and (b) an object hanger suspended from at least one of said carrier arms, said object hanger including:

(i) a hanging strap;

(ii) means for mounting an upper end of said hanging strap to one of said carrier arms; and (iii) fastening means secured to the hanging strap for releasably securing an object to said hanging strap for visual diplay, wherein said fastening means is a fastening strip having opposite ends connectable with each other to define a support loop for receiving and supporting said object on the hanging strip.

* * * * *